US005152617A

United States Patent [19]

Smith

[11] Patent Number: 5,152,617

[45] Date of Patent: Oct. 6, 1992

[54] STENOGRAPHIC MACHINE HAVING POWER DRIVEN NOTE MARKER

[75] Inventor: Gordon W. Smith, San Marcos, Calif.

[73] Assignee: Xscribe Corporation, San Diego, Calif.

[21] Appl. No.: 780,712

[22] Filed: Oct. 18, 1991

[51] Int. Cl.[5] ..... B41J 3/26

[52] U.S. Cl. ..... 400/94; 400/482; 400/91

[58] Field of Search ..... 400/91-94, 400/482

[56] References Cited

U.S. PATENT DOCUMENTS

| | | | |
|---|---|---|---|
| 4,024,943 | 5/1977 | Steiner | 400/91 |
| 4,176,973 | 12/1979 | Gregory et al. | 400/91 |
| 4,205,351 | 5/1980 | Michals | 400/94 |
| 4,363,557 | 12/1982 | Fowler et al. | 400/103 |
| 4,439,798 | 3/1984 | Chvojcsek | 400/94 |

FOREIGN PATENT DOCUMENTS

| | | | |
|---|---|---|---|
| 2542888 | 9/1984 | France | 400/94 |

*Primary Examiner*—Edgar S. Burr
*Assistant Examiner*—Lynn D. Hendrickson
*Attorney, Agent, or Firm*—Graham & James

[57] ABSTRACT

A stenographic machine of the type having a platen means for supporting a paper tape and a memory means for electronically storing stenographic notes as well as a plurality of keys and associated electromechanical elements for recording testimony and proceedings on the paper tape or electronic memory. More particularly, the stenographic machine and the present invention includes a note marker assembly including at least one input key which is electromechanically connected to initiate the translation of an ink pad into contact with the paper tape, and for simultaneously inserting an electronic mark into a memory means.

12 Claims, 2 Drawing Sheets

STENOGRAPHIC MACHINE HAVING POWER DRIVEN NOTE MARKER

FIELD OF THE INVENTION

The present invention relates generally to stenographic machines and, in particular, relates to a position flag or note marker mechanism therefore.

BACKGROUND OF THE INVENTION

A stenographic machine is a device used by court reporters to record the proceedings of a court or a deposition in a silent and efficient manner. The basic stenographic machine has been in use for over 40 years. These basic stenographic machines are shown for example in U.S. Pat. Nos. 2,319,273; 2,387,330; 2,392,078; and 2,292,781. Originally stenographic machines would record exclusively onto a paper tape. Modern stenographic machines have adapted the basic mechanism to digital computer technology through the addition of such items as floppy disk drives, random access computer memories, internal modems and the like. Despite the addition of such technological advancements, the basic mechanical mechanism has remained essentially unchanged.

Generally the stenographic machine includes a number of keys which correspond to phonic symbols to produce an output to be typed onto the tape or recording medium. The output is a row of letters arranged in a specialized shorthand notation. Successive phonic symbols are recorded in a subsequent row slightly below the preceding symbol. Thus it may be readily apparent that a relatively simple sentence may produce an output having several inches of paper tape length. Accordingly, it will also be readily apparent that during the course of a court proceeding the stenographic recording is extremely voluminous.

It may also be appreciated that there will be times during the court proceeding in which the stenographer operating the stenographic machine will be requested to locate and re-read a previously recorded portion of the proceeding. This process requires the stenographer to look back through the volume of tape produced, find the appropriate section, and read it to the court. It would be useful if the stenographer had a means for producing markers or flags which could be readily located on the tape to assist the stenographer in finding a previously entered transcription. Thus, for example, it would be advantageous if each witnesses testimony could be separated by a marker or a flag which could be readily found by the stenographer. Accordingly, the present invention is directed a stenographic machine which includes a means for placing a flag or marker on the stenographic record.

SUMMARY OF THE INVENTION

The present invention is directed to a stenographic machine of the type having a platen means for supporting a paper tape and a memory means for electronically storing stenographic notes as well as a plurality of keys and associated electromechanical elements for recording testimony and proceedings on the paper tape and electronic memory. More particularly, the stenographic machine of the present invention includes a note marker assembly including at least one input key which is electromechanically connected to initiate the translation of an ink pad into contact with the paper tape, and for simultaneously inserting an electronic mark into an electronic memory. In the preferred embodiment, the stenographic machine includes two keys which are positioned slightly above the plurality of phonic keys such that the operator may readily depress the two keys to initiate the note marking sequence. The two keys correspond to two different colors of ink on the ink pad device, and to two distinct electronic marks in the memory. Thereby, depressing one key will produce a first color output onto the paper tape and a first selected electronic mark on the memory, and depressing the second key will produce a second colored ink mark on the tape and a second electronic mark on the memory. For example, the first color ink may be green and the second color ink may be red. Accordingly, it may be readily appreciated that the present invention provides an improved stenographic machine which allows the stenographer to readily locate previously flagged or marked portions of the transcription, by placing marks thereat. Other features and advantages of the present invention will become apparent from consideration of the following detailed description and the accompanying drawings.

DETAILED DESCRIPTION OF PREFERRED EMBODIMENT

Figure 1:
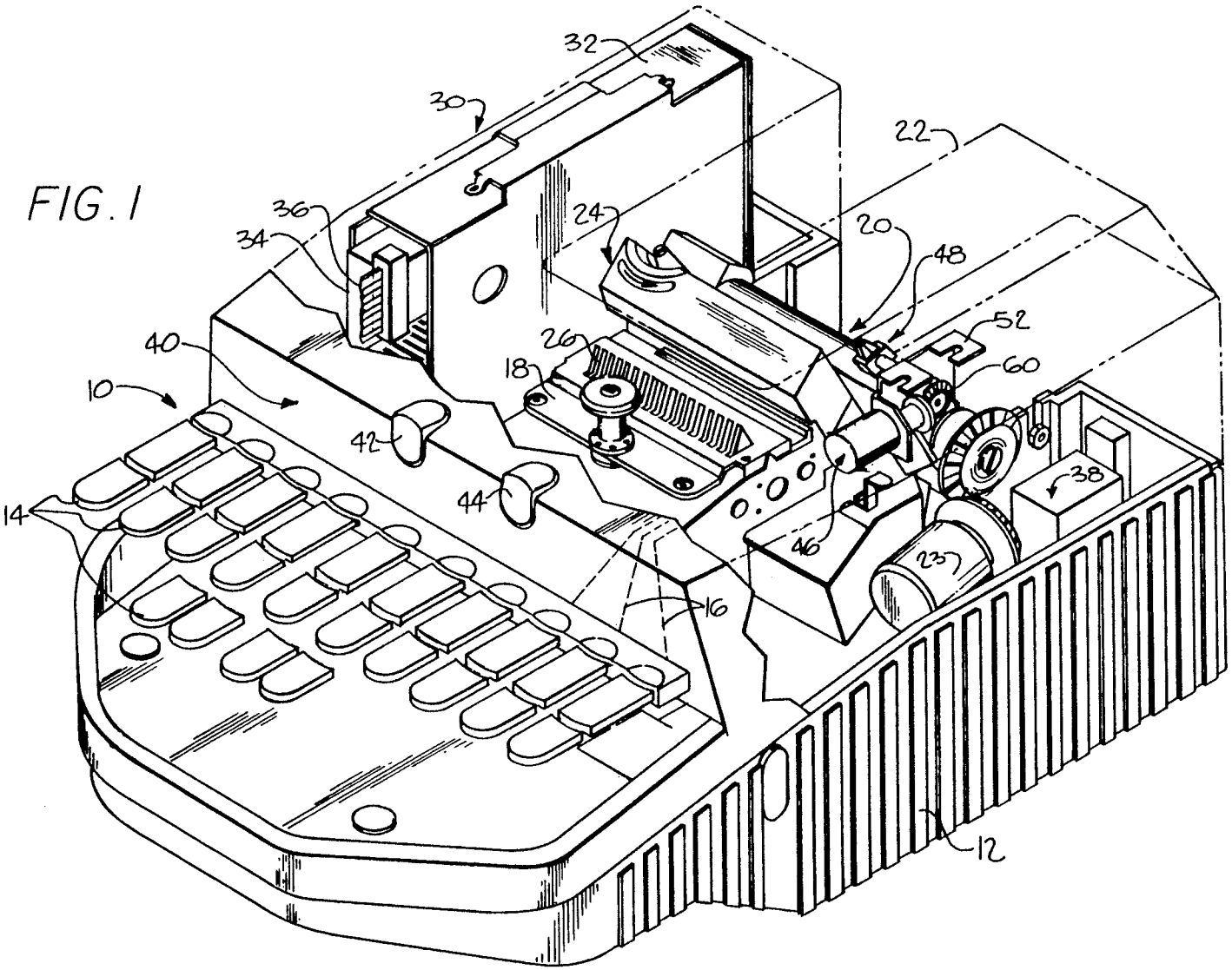
FIG. 1 shows a detailed perspective view of a stenographic machine incorporating a note taking system according to the present invention.

In FIG. 1, a stenographic machine 10 according to the present invention is depicted in a perspective view wherein a portion of the cover thereof has been removed to allow visual depiction of the internal working mechanisms of the stenographic machine 10. The stenographic machine 10 includes a base housing assembly 12 upon and within which are mounted a plurality of keys 14 which are interconnected by linkage means 16 to a trunion assembly 18. The stenographic machine assembly 10 also includes a platen assembly 20 mounted for rotation proximate the trunion assembly such that a stenographic tape 22 may be fed between the platen assembly 20 and trunion assembly 18. Additionally, the stenographic tape 22 is in frictional contact with the platen assembly 20, which is rotated by a motor 23 during the course of operation of the stenographic machine 10. An inked ribbon 24, such as depicted in applicants co-pending application Ser. No. 07/736,462, filed Jul. 26, 1991 herein incorporated by reference, is preferably disposed between the trunion assembly 18 and the stenographic tape 22 carried on the platen assembly 20. Thus, as the plurality of keys are sequentially depressed, an output is produced at the trunion assembly whereby individual trunion elements 26 will impact against the stenographic tape 22, supported by the platen assembly 20, causing marks thereon, and the platen assembly 20 will rotate advancing the stenographic tape 22.

The stenographic machine 10 also includes an electronic memory means 30 which includes a disk drive means 32 for receiving and recording information on floppy or hard disks (not shown). The electronic memory means 30 also includes an electronic signal processor 34 interconnected to the disk drive means 32 to provide data signal information thereto, as well as a data cable 36 extending from a main circuit board 38 to the electronic signal processor 34. All of these elements are essentially standard items and a detailed description of the workings thereof is therefor not provided.

As can be further appreciated in FIG. 1, the stenographic machine 10 includes switch means 40 mounted slightly above the plurality of keys 14 of the stenographic machine 10. Preferably, the switch means 40 includes a pair of switches, left switch 42 and right switch 44. When depressed, the left and right switches 42, 44 activate an electronic circuit 45 (FIG. 3) which produces a specific output to a motor means 46 which in turn drives an ink marker means 48. The ink marker means 48 is adapted for making distinctive ink marks on the stenographic tape 22 when the left or right switch 42, 44 is depressed, thereby activating the motor means 46. The motor means 46 and ink marker means 48 are shown in greater detail in the exploded view of FIG. 2.

Figure 2:
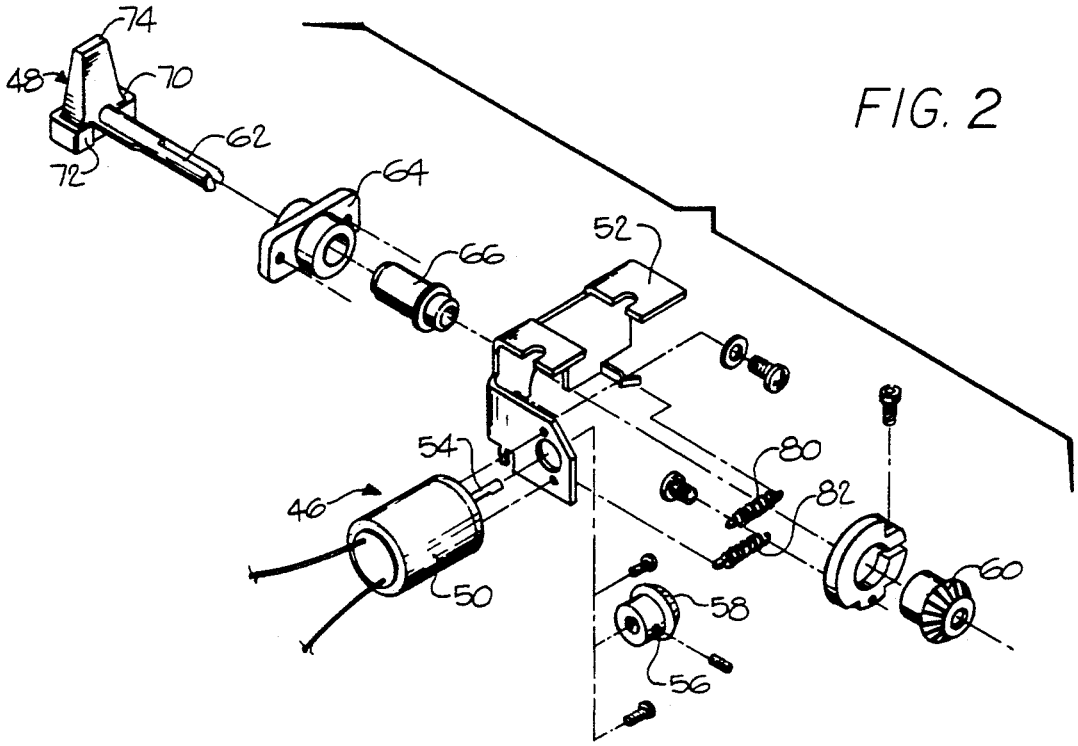
FIG. 2 is a view showing an exploded view of the note taking mechanism.

In FIG. 2, the motor means 46 is depicted including an electric motor 50 which is mounted to a mounting assembly 52. The motor 50 includes an output shaft 54 which is attached to and drives a gear element 56. The gear element 56 includes a bevel gear 58 which in turn drives a driven gear 60. The driven gear 60 is attached to the end of a shaft arm 62 of the ink marker means 48. The ink marker means 48 is secured via a holder 64 and bushing 66 to the mounting assembly 52, such that the projection of the axis of the shaft arm 62 intersects at a right angle with the axis of the motor shaft 54, such that the gear element 56 drives the driven gear 60 at a right angle. As depicted, the ink marker means 48 is essentially cantilevered at the end of shaft arm 62 and includes a first ink pad 70 and a second ink pad 72, both of which are attached to a counterweight 74.

When assembled into the stenographic machine 10 of FIG. 1, the ink marker means 48 is so arranged as to have the first ink pad 70 and second ink pad 72 located proximate to the stenographic tape 22. When the left switch 42 (or right switch 44) is depressed, the first ink pad 70 (or second ink pad 72 respectively) will rotate to contact the stenographic tape 22 and leave a mark thereon. Accordingly, the motor means 46 and specifically the motor 50 thereof are so arranged to drive the ink marker means 48 through either a clockwise or counter-clockwise rotation to engage the first ink pad 70 or second ink pad 72 with the stenographic tape 22 upon command.

The motor 50 is so arranged as to have the electrical input to the motor 50 continue until the torque resistance to rotation of the motor 50 increases to a set limiting value, whereupon the motor 50 is switched off and springs 80, 82, illustrated in FIG. 2, will then return the ink marker means 48 into its holding or waiting position. This is particularly advantageous in that the clarity of the notemarks is independent of the force required to depress the left and right switches 42, 44, and a uniform and distinct notemark is placed on the stenographic tape 22.

Accordingly, with the improved stenographic device of the present invention, the stenographer can put a green mark, a red mark or a plurality of successive marks in any decisional pattern on the edge of the tape to flag or mark the tape for subsequent use in locating a specific position on the tape. Thus, for example, at the beginning of an examination of a witness the stenographer may put a green mark, at the end of the direct examination and at the beginning of cross-examination the stenographer may put a red mark, and comments by the court or by either attorney may be identified or flagged by a green/red or red/green series of marks. Similarly, the two distinct electronic marks on the memory means may be subsequently searched by an appropriate computer program, for segregating various portions of the transcription.

As can be appreciated from the description above, the basic operation of the stenographic machine 10 includes the motor 23 to drive the platen assembly 20 to advance the stenographic tape 22 during recording of court proceedings. Thus, in order to prevent the note marker subassembly from contacting the stenographic tape 22 during rotation of the platen assembly 20, the electronics controlling the operation of the motor 50 includes an override which will allow the platen drive motor 23 to complete a rotation prior to allowing the motor 50 to engage the ink marker means 48 into contact with the stenographic tape 22. It is also desirable that the ink marker means 48 and more particularly the first ink pad 70 and second ink pad 72 thereof are positioned so as to contact the stenographic tape 22 at or near the same outside edge thereof, to thereby allow the operator of the stenographic machine assembly 10 to look at a pile or continuous roll of the stenographic tape 22 and locate specific notemarks.

It may be appreciated from the above description that the motor 50 of the motor means 46 as described herein is essentially a step motor which can rotate in either a clockwise or counter clockwise direction to drive the ink marker means 48 in a clockwise or counter clockwise direction to cause either the first ink pad 70 or second ink pad 72 to come into contact with the stenographic tape 22. However, it may readily be appreciated that other types of devices, such as a pair of electromagnetic solenoids, which move ink pads in a linear manner into contact with the stenographic tape 22, may be substituted without significantly altering the concept of the present invention. Thus, while the details of the present invention including the rotating type motor 50 are depicted herein, it shall be appreciated that the scope of this patent is limited only by the claims appended hereto.

Figure 3:
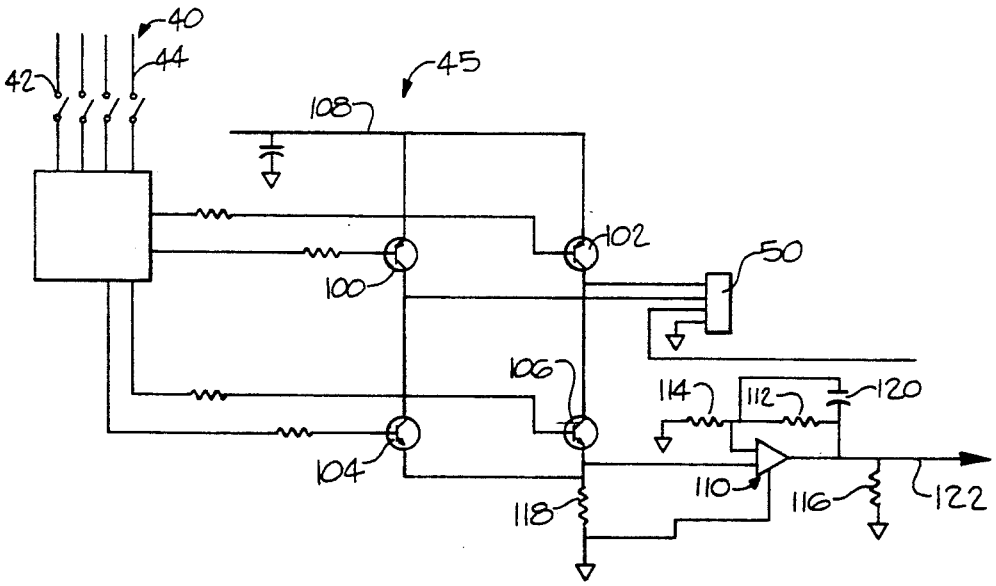
FIG. 3 is a block diagram of the electronic circuitry required for producing the mechanical output of the present invention.

FIG. 3 schematically depicts the electronic circuit 45 which controls the operation of the note marker subassembly, and is physically on the main circuit board 38. In FIG. 3 the drive circuits of the motor 50 are illustrated as having an H bridge configuration, with inputs from the left and right switches 42, 44 (shown schematically) which allows the motor 50 to be driven in either the clockwise or counter clockwise direction by applying either a positive or negative voltage to the motor terminals. The note marker H bridge consists of transistors 100, 102, 104 and 106, and operates in a conventional manner to direct power from line 108 to the motor 50. The note marker motor 50 (shown as a box) does not have a breaking phase, it simply runs clockwise or counter clockwise until one of the ink pads 70 or 72 hits the platen assembly 20 and then the motor 50 is turned off and is returned to the center position by springs 80 and 82. A current sensing circuit consists of a operational amplifier 110 and resisters 112, 114, 116 and 118, as well as a capacitor 120, which are used to determine when the respective ink pad 70, 72 hits the platen assembly 22, and cause the motor 50 to turn off. Resister 118 generates a small voltage when current from the motor 50 passes through it. This voltage is amplified by operational amplifier 110 with a gain. The capacitor 120 forms a low pass filter, for example, of 1 kilohertz, to prevent false signals from shutting down the motor 50. The output 122 from this current sensing circuit is returned to the main circuit board 38, and ultimately the main controller (not shown) thereof.

Simultaneous with the operation of the motor means 46 and ink marker means 48, an electronic signal indicating that a notemarker is being place by depression of the left or right switch 42, 44 is also routed to the disk drive means 32 to record an appropriate notemark on the floppy or hard disk. When the floppy or hard disk is later interrogated by a computer, these electronic notemarks are searchable and can assist the operator in locating specific portions of the text, and in correlating the electronic memory with the stenographic tape 22.

It should be evident from the foregoing description that the present invention provides advantages over stenographic machines of the prior art. Although preferred embodiments are specifically illustrated and described herein, it will be appreciated that many modifications and variations of the present invention are possible in light of the above teaching to those skilled in the art. It is preferred, therefore, that the present invention be limited not by the specific disclosure herein, but only by the appended claims.

What is claimed is:

1. A notemarker for a stenographic machine of the type having platen means for supporting a paper tape and memory means for electronically storing stenographic notes, comprising:

switch means, mounted on said machine, for activating said notemarker, electro-mechanical means for placing physical notemarks of essentially uniform quality on said tape, said electro-mechanical means including ink marker means for making an ink mark on said tape, and motor means adapted to engage said ink marker means and activated by said switch means, for moving said ink marker means against said tape to make said ink mark; and electronic means for inserting electronic notemarks into said memory means.

2. The notemarker as defined in claim 1, wherein:

said ink marker means includes at least two ink pads capabale of making at least two colors of ink marks on said tape; and said switch means includes at least two switches, each corresponding to one of said colors, for selecting the particular one of said ink pads to be applied to said tape.

3. The notemarker as defined in claim 2, wherein said motor means is capable of clockwise or counter clockwise motion whereby activating one of said switches will cause said motor means to rotate one of said ink pads against said tape.

4. The notemarker as defined in claim 1, wherein said electronic means comprises:

disk drive means for recording information on recording disks; and circuitry means for inserting an electronic code notemark into said recorded information recorded by said disk drive means upon activation of said switch means.

5. The notemarker as defined in claim 4, wherein said circuitry means comprises:

data code means for defining a unique electronic mark; and circuit means for directing said code means to said disk drive means responsively to the activation of said switch means.

6. An improved stenographic machine of the type having recording means for recording stenographic notes comprising:

notemarker means for placing identifiable positioning marks on the stenographic recording made by said machine, said notemarker means including electro-mechanical means for placing physical marks on a stenographic tape passing through said machine; and switch means operable by the operator of said machine to activate said notemarker means, said switch means having two switches and said electro-mechanical means being responsive to said switch means, said electro mechanical means further includes an ink marker capable of making marks of two colors on said tape and a motor adapted to engage said ink marker and to rotate in clockwise and counter clockwise directions responsively to the activation of said two switches respectively to selectively place marks of said two colors on said tape; and electronic means, responsive to said switch means, for inserting electronic marks into a memory in said machine.

7. The machine as defined in claim 6 wherein said ink markers of said notemarker means is positioned relative to said platten such that said marks on said type are placed proximate the edge of said tape for viewing from the side of a stack of said tape.

8. The machine as defined in claim 6 wherein said switch means are physically positioned on said stenographic machine at a location allowing the machine operator to activate said switch means while maintaining appropriate hand position for normal stenography operation.

9. The machine as defined in claim 6 further comprising:

electronic circuitry means for sensing and producing an output signal when said ink marker has contacted said tape to place a mark thereon and for de-activating said motor in response to said output signal.

10. A method of selectively placing identifiable positioning marks on a stenographic record, comprising:

providing a stenographic machine including a switch activated, electro-mechanical notemarker for placing identifiable uniform positioning marks on the stenographic recording made by said machine;

activating said switch to engage said notemarker during the recording of a stenographic record;

energizing a motor causing rotation in either a clockwise or counter clockwise direction in response to the activation of said switch; and displacing an ink marker from a first position to a second position in response to the rotation of said motor to cause said ink marker to make a mark on said tape.

11. The method according to claim 10 further comprising:

providing and activating an electronic means, responsive to activation of said switch means, for inserting electronic marks into a memory in said machine.

12. The method according to claim 11 further comprising:

providing two switches; and displacing an ink marker capable of making marks of two colors on said tape by energizing said motor causing rotation in a clockwise or counter clockwise direction in response to the activation of said switches to selectively place markers of said two colors on said tape.

* * * * *